United States Patent [19]

Hill et al.

[11] 4,231,242

[45] Nov. 4, 1980

[54] PLUG FOR A KEY OPERATED LOCK

[75] Inventors: Lewis J. Hill, Grove; Bill J. Dillard, Mustang, both of Okla.

[73] Assignee: U-Change Lock Industries, Inc., Oklahoma City, Okla.

[21] Appl. No.: 953,932

[22] Filed: Oct. 23, 1978

Related U.S. Application Data

[63] Continuation of Ser. No. 800,699, May 26, 1977, abandoned.

[51] Int. Cl.[3] ..... E05B 15/06

[52] U.S. Cl. ..... 70/347; 70/385; 70/364 A

[58] Field of Search ..... 70/345–347, 70/356, 364 A, 372, 375, 382, 385, 387, 406, 412, 420, 453–454

[56] References Cited

U.S. PATENT DOCUMENTS

| | | | |
|---|---|---|---|
| 437,939 | 10/1890 | Sargent | 70/453 |
| 446,176 | 2/1891 | Shaw | 70/453 |
| 471,453 | 3/1892 | Wohlmuth | 70/387 |
| 1,462,869 | 7/1923 | Primak | 70/453 |

*Primary Examiner*—Robert L. Wolfe

*Attorney, Agent, or Firm*—Dunlap, Codding & McCarthy

[57] ABSTRACT

A plug for a key operated lock is provided with a plurality of bores transverse to the key slot formed through the plug. The bores accept studs which extend into the key slot to delimit the design of key blanks from which keys, fitting the lock, can be constructed. The selection of bores to contain studs permits rapid change of key blank designs for the lock.

2 Claims, 3 Drawing Figures

PLUG FOR A KEY OPERATED LOCK

CROSS REFERENCE TO RELATED APPLICATION

The present application is a continuation of the applicants' United States Patent Application Ser. No. 800,699, filed May 26, 1977, and now abandoned and entitled "AN IMPROVED PLUG FOR A KEY OPERATED LOCK".

BACKGROUND OF THE INVENTION

1. Field of the Invention

This invention relates to key operated locks and more particularly, but not by way of limitation, to locks forming members of a set operated by keys constructed from identical key blanks.

2. Brief Description of the Prior Art

In many businesses and other organizations in the United States, it has become standard practice to customize locks to the particular organization. Such customization is carried out by configuring the key slots in the locks to accept keys made only from key blanks having a unique pattern of longitudinal grooves formed in the sides of such blanks. The supplier of the locks and keys will provide appropriate key blocks only to persons authorized to receive such blanks by the organization. The purpose of this exclusivity is to increase the difficulty of unauthorized entry into the organization's physical establishment. It is not sufficient for purposes of entry that one have a key having an edge contour appropriate to a particular lock; the key must also have been made from a particular key blank.

In the course of time, the security of an organization using such a lock system may become compromised by the loss of control of one or more keys. For example, an organization may lose control of a key by the loss thereof by an employee or by the failure of an employee to return his keys to the organization when he leaves its employ. Usually, the circumstances of the loss in control of keys are not such that the expense of procuring a complete new set of locks requiring a new key blank design is justified. Under these circumstances, the locks fitting the lost key are changed to require a new edge contour but the design of the key blank is not changed. Locks have been developed in which a change involving only a new edge contour may be carried out rapidly without disassembling the lock. An example of such a lock is disclosed in U.S. Pat. No. 3,589,153, issued June 29, 1971 to Lewis J. Hill.

Although the added security afforded by customized keys is lost in the course of time by loss of keys, changes in key slot and key blank design have been rare. While routine changes of this type are desirable, the cost has generally been prohibitive.

The excessive expense of changing a lock system to require a new key blank design has arisen, in the past, from the manner in which foreign keys have usually been excluded. In general, locks designed for exclusive use by one organization include a plug rotatable within a lock body for unlocking doors, padlocks and the like. The key is inserted into a slot extending longitudinally into the plug and rotated to rotate the plug. Heretofore, locks have been customized for a particular key blank by forming a set of ridges on the portions of the plug forming the walls of the slot, the ridges extending parallel to the longitudinal axis of the slot. The key blanks are provided with a corresponding set of grooves so that the ridges and grooves will mesh when the key is inserted into the slot. If the key is made from a different blank, meshing of one ridge and groove will, in general, prevent meshing of at least one other ridge and groove so that at least one ridge will obstruct a portion of the key to prevent insertion of the key into the key slot.

With exclusivity based on ridges formed in a key slot, it is necessary to change plugs in order to change the in-house key blank design. Since it is not economically feasible to add ridges within the narrow confines of a key slot, the plug cannot be changed to bar insertion of a blank for which it was originally manufactured.

The problem of expense has been exacerbated in the past by the manner in which the ridges in the key slot have been formed. It will be recognized that the more precisely the ridges are positioned and shaped, the more precise must be the match between the ridges and grooves and, accordingly, the more secure the lock system. In a high quality lock, a broaching operation has been used heretofore to establish close tolerances in the positioning and shaping of the ridges. The plug has been initially rough cast from a readily machinable, and relatively expensive, material, and an appropriately shaped broach, ground from tool steel, has been driven into the key slot to provide the final shape of the ridges. The broach adds considerably to the cost of locks, whether the cost be incurred when the locks are initially purchased or when the plugs are changed.

The broaches used in key slot shaping operations are ground from tool steel and may be several feet in length. Clearly, the cost of such broaches is not inconsequential. Moreover, even with proper care, broaches are subject to breakage. Since the costs of broaching must be recovered by the manufacturer in the price he receives for the plugs, the plugs are relatively expensive items.

A second problem is also associated with locks having broached key slots. In general, a considerable time lapse occurs between the recognition that the change in key slot and key blank design must be made and the effectuation of the change. The manufacture of the broach to form the key slots and the subsequent manufacture of the plugs for the locks requires an undesirable time lag in meeting a known compromise of a lock system.

It is known to use a pin in a lock plug to mate with a groove in a key for guiding the key within a key slot. Such a pin, used for this purpose, has been disclosed in U.S. Pat. No. 1,462,869, issued to Primak. It is also known to provide multiple lugs or ridges within a key slot to prevent the insertion of keys other than keys specifically designed for the lock in which the key slot is formed. Wohlmuth, U.S. Pat. No. 471,543, discloses a lock which is opened by insertion of a key into a key slot and which uses lugs or ridges in the key slot to prevent insertion of a foreign key. However, the problem of constructing a lock to permit rapid and inexpensive change of key slot and key blank design has heretofore remained unsolved.

SUMMARY OF THE INVENTION

The problems of high expense and undesirable time lag in changing the design of key blanks used in a lock system have been solved in the present invention by eliminating the use of ridges in a key slot as a means of making the locks in a system specific to a particular key blank design. Instead, a substantially rectangular key slot is formed in the plug, either by casting or milling or both, and stud bores are formed in the plug to accept studs, projecting into the key slot, which determine the design of the key blank. Since the positions of the studs must be changed by inserting studs through different stud bores, changing plugs is no longer required to change key blank design. Equally important, the initial cost of the plugs is reduced by eliminating the need for broaching the key slot.

An object of the present invention is to provide a lock wherein the key blank design may be changed at a low cost.

Another object of the invention is to provide a lock wherein the key blank design can be changed in a short time span.

Other objects, advantages and features of the present invention will become clear from the following detailed description of the preferred embodiment of the invention when read in conjunction with the drawings and appended claims.

DESCRIPTION OF THE PREFERRED EMBODIMENT

Figure 1:
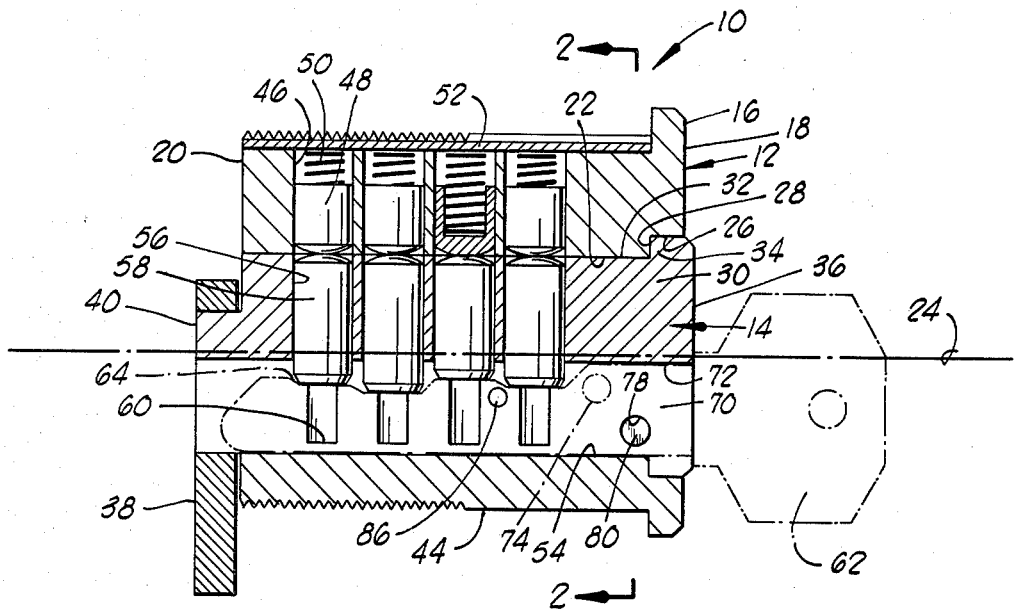
FIG. 1 is a longitudinal sectional view of a lock incorporating the improved plug of the present invention.

It is contemplated that the present invention will be utilized in a lock having the rapid key change capability described in the aforementioned U.S. Pat. No. 3,589,153, issued June 29, 1971 to Lewis J. Hill, and the disclosure of that patent is incorporated herein by reference. However, it is to be understood that no limitation in the application of the present invention is to be implied from such incorporation. It will be clear to those skilled in the art that the present invention may be used with a wide variety of locks.

While the construction and operation of a preferred lock in which the present invention may be used are described in the above referenced patent so that a detailed description thereof is unnecessary herein for purposes of disclosure of the present invention, a brief description of such a lock will perhaps contribute to the understanding of the present invention and the use thereof. Referring to the drawings, shown therein and designated by the general reference numeral 10 is a lock generally comprising a lock body 12 and a plug 14 constructed in accordance with the present invention.

The lock body 12 is generally cylindrical in configuration and is provided with a flange 16 at one end 18 to abut a door or other member in which the lock 10 may be installed. A portion of the lock body 12 is threaded, near the other end 20 thereof, to permit the lock 10 to be secured to the door or other member.

A cylindrical bore 22 is formed in the lock body 12, the bore 22 extending through the lock body 12 about a longitudinal axis 24 to intersect the ends 18, 20 of the lock body 12. The bore 22 has an enlarged portion 26 providing the bore 22 with a shoulder 28. The plug 14 comprises a cylindrical plug body 30 dimensioned such that, in the assembled lock 10, the cylindrical periphery 32 of the plug body 30 engages the bore 22 of the lock body 12 and the longitudinal axis 24 forms a cylinder axis for the plug body 30. A flange 34 is formed on one end 36 of the plug body 30, the flange 34 engaging the shoulder 28 in the assembled lock 10 for longitudinal positioning of the plug 14 within the lock body 12. A latch member 38 is secured to the other end 40 of the plug body 30, the latch member 38 serving the dual purposes of securing the plug 14 to the lock body 12 and of engaging a door jamb slot or other recess to lock the door or other member in which the lock 10 is installed. A dovetail slot 42 (see FIG. 2) is formed in the cylindrical periphery 44 of the lock body 12, and a plurality of driver bores 46 are formed in the lock body 12, the driver bores 46 extending substantially radially, with respect to the axis 24, through a portion of the lock body 12 to intersect the dovetail slot 42 and the cylindrical bore 22. A driver 48 is disposed within each driver bore 46 to urge the driver 48 generally toward the cylindrical bore 22. For clarity, only one driver bore 46, driver 48 and spring 50 have been numbered in FIG. 1. One driver 48 has been drawn in cross section to illustrate the construction thereof. A closure plate 52, inserted into the dovetail slot 42, retains the drivers 48 and springs 50 within the driver bores 46.

The plug body 30 has a key slot 54 extending in a longitudinal direction with respect to the axis 24, and a plurality of tumbler bores 56 are formed in the plug body 30, the tumbler bores 56 intersecting the cylindrical periphery 32 of the plug body 30 and the key slot 54. A tumbler 58 is disposed within each tumbler bore 56, and portions of the tumblers 58 extend into the key slot 54. For clarity, only one tumbler and tumbler bore have been numbered in FIG. 1. In a locking orientation of the plug 14 with respect to the lock body 12, illustrated in FIGS. 1 and 2, the tumblers 58 are engaged by the drivers 48.

It will perhaps be well at this point to consider the operation of the lock 10. The springs 50 urge the drivers 48 against the tumblers 58 such that the tumblers 58 are driven toward seats 60 disposed in portions of the plug body 30 intersected by the key slot 54. In a seated condition of the tumblers 58 (not illustrated), the drivers 48 extend partially into the tumbler bores 56 to fix the plug 14 in the locking orientation. In this orientation, the latch member 38 will engage a door jamb slot or other recess in the usual manner, and the door or other member in which the lock is installed cannot be opened.

Figure 2:
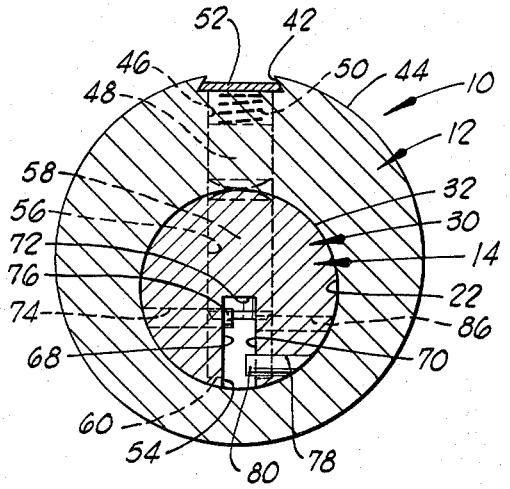
FIG. 2 is a transverse sectional view of the lock taken substantially along line 2—2 of FIG. 1.

When a key 62, as indicated by broken lines in FIG. 1, is inserted into the key slot 54, the tumblers 58 are lifted from the seats 60. If the key has an appropriate edge contour 64, the tumblers 58 and the drivers 48 will be positioned such that the tumblers 58 are disposed wholly within the tumbler bores 56 and the drivers 48 are disposed wholly within the driver bores 46 as indicated in FIGS. 1 and 2. With such a disposition of the drivers 48 and tumblers 58, the plug 14 may be rotated to disengage the latch member 38 from the door jamb slot or other recess engaged thereby so that the door or other member in which the lock 10 is installed may be opened. If the key edge configuration 64 is inappropriate to the lock 10, on the other hand, portions of one or more of the drivers 48 will, in general, project into tumbler bores 56 and portions of one or more tumblers 58 will, in general, project into driver bores 46 to fix the plug 14 at the locking orientation so that the door or other member in which the lock 10 is installed cannot be opened.

Figure 3:
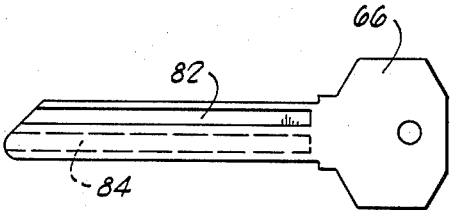
FIG. 3 is a key blank used with the improved plug of the present invention.

It is clear from the above description of the operation of the lock 10 that a key 62, even a key 62 with a proper edge contour 64, will be unable to operate the lock 10 if the key 62 cannot be inserted into the lock 10 to a sufficient depth such that the appropriate portions of the edge contour 64 thereof engage the appropriate tumblers 58. In order to provide added security to the work or other areas secured by a door or other member in which the lock 10 is installed, the plug 14 is constructed such that the key 62 must be made from a key blank 66 (FIG. 3) having a preselected design.

The key slot 54 in the plug body 30 is substantially rectangular in shape and, in the preferred embodiment illustrated in FIGS. 1 and 2, intersects a portion of the cylindrical periphery 32 of the plug body 30, the key slot 54 extending therefrom a distance into the plug body 30 generally toward the axis 24. Such a key slot 54 may be easily and economically formed by casting the plug body 30 such that the key slot 54 is formed in the casting or by milling or by combination of casting and milling. The transverse limits of the key slot 54 are formed by a first internal side wall 68 and a second internal side wall 70 of the plug body 30, and the extent of the key slot 54 toward the axis 24 is delimited by an internal upper slot surface 72.

A first stud bore 74 (indicated by broken lines in FIGS. 1 and 2) is formed in the plug body 30, the first stud bore 74 intersecting the first internal side wall 68, and extending therefrom, substantially perpendicularly to the first internal side wall 68, to the cylindrical periphery 32 of the plug body 30. A first stud 76 is pressed into the first stud bore 74 and projects a preselected distance into the key slot 54 to form an obstruction therein. Similarly, a second stud bore 78 is formed in the plug body 30, the second stud bore 78 intersecting the second internal side wall 70 and extending substantially perpendicularly therefrom to the cylindrical periphery 32 of the plug body 30. A second stud 80 is pressed into the second stud bore 78 and projects a preselected distance into the key slot 54 to from another obstruction therein.

In order that a key 62 may be used to operate the lock 10, the key blank 66, from which the key 62 is made, is provided with a first groove 82 positioned on the key blank 66 and cut to a depth therein such that the first stud 76 will slide within the first groove 82 when the key 62 is inserted into the key slot 54. A second groove 84 is cut in the key blank 66 to provide clearance between the key 62 made therefrom and the second stud 80.

One or more of an auxiliary stud bore is formed in the plug body 30, one such auxiliary stud bore having been shown in FIGS. 1 and 2 and designated by the numeral 86 therein. No stud is disposed in the bore 86 when the lock 10 is furnished to the user thereof but, rather, provides a rapid means of changing the key blank design should a design which is used become compromised. In particular, the plug body 30 is removed from the lock body 12 and the second stud 80 is removed from the second stud bore 78. An auxiliary stud (not shown) is then inserted in the auxiliary stud bore 86 such that a key 62 formed from the blank 66 can be inserted only to a depth such that the key 62 engages the auxiliary stud (not shown). Since such depth is insufficient to permit the edge contour 68 of the key 62 to engage all tumblers 58 of the lock 10, the key 62 can no longer be used to open the lock 10. As has been shown in FIG. 1, the stud bores 74, 78 and 86 can be longitudinally spaced such that substantially the entire longitudinal dimension of the plug body 70 is available for the positioning of stud bores. Moreover, the auxiliary stud bores, such as the bore 86, can be formed to either side of the key slot 54. Accordingly, the lock 10 can be constructed to permit numerous key blank design changes by forming the plug body 30 with a plurality of auxiliary stud bores such as the stud bore 86.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An improved plug for a key operated lock having a lock body, comprising:

a cylindrical plug body removably supported by the lock body and having a key slot formed longitudinally therein, the plug body having a first internal surface defining one transverse limit of the key slot and a second internal surface defining another transverse limit of the key slot, the plug body having a plurality of stud bores intersecting the cylindrical periphery of the plug body and the first internal surface of the plug body, and the plug body having a plurality of stud bores intersecting the cylindrical periphery of the plug body and the second internal surface of the plug body;

a first stud member secured within one of the stud bores intersecting the first internal surface and having a portion thereof projecting into the key slot; and a second stud member secured within one of the stud bores intersecting the second internal surface and having a portion projecting into the key slot so that the first and second stud members coact to only permit entry into the key slot of a key having a preselected key blank design determined by the selected placement of stud members in the stud bores.

2. An improved plug for a key operated lock comprising:

a cylindrical plug body having a key slot form therein, the key slot having first and second parallel side wall defining the transverse limit of the key slot and extending in a longitudinal direction with respect to the cylinder axis of the plug body, the plug body having a plurality of stud bores formed therein extending in a substantially transverse direction with respect to the cylinder axis of the plug body, at least one of the stud bores intersecting the key slot along the first internal side wall and at least one of the stud bores intersecting the key slot along the second internal side wall, the stud bores characterized as being longitudinally spaced with respect to the cylinder axis of the plug body; and at least one stud member secured within a selected stud bore and having a portion projecting into the key slot.

* * * * *